US007239834B2

(12) United States Patent
Kuramoto et al.

(10) Patent No.: US 7,239,834 B2
(45) Date of Patent: Jul. 3, 2007

(54) TRANSPORT BELT AND IMAGE FORMATION DEVICE USING THE SAME

(75) Inventors: Shinichi Kuramoto, Ebina (JP); Noburo Wada, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 117 days.

(21) Appl. No.: 10/743,061

(22) Filed: Dec. 23, 2003

(65) Prior Publication Data

US 2004/0247347 A1 Dec. 9, 2004

(30) Foreign Application Priority Data

Jun. 5, 2003 (JP) ..... 2003-160323

(51) Int. Cl.
*G03G 15/01* (2006.01)

(52) U.S. Cl. ..... 399/302; 399/313

(58) Field of Classification Search ..... 399/303, 399/312, 313, 302

See application file for complete search history.

(56) References Cited

U.S. PATENT DOCUMENTS 2,930,104 A * 3/1960 Watts et al.
5,802,442 A * 9/1998 Konno et al.
5,832,351 A * 11/1998 Takekoshi et al. ..... 399/303
6,044,243 A * 3/2000 Hara ..... 399/302
6,066,400 A * 5/2000 Law et al. ..... 399/313
6,078,775 A * 6/2000 Arai et al. ..... 399/302
6,489,020 B1 * 12/2002 Caruthers et al. ..... 399/302
6,737,133 B2 * 5/2004 Kusaba et al. ..... 399/302
2003/0008098 A1 * 1/2003 Yuan et al. ..... 399/313
2003/0053822 A1 * 3/2003 Sato et al. ..... 399/302
2003/0063929 A1 * 4/2003 Oohara et al. ..... 399/302
2003/0157419 A1 * 8/2003 Miyakawa et al. ..... 399/302
2003/0235442 A1 * 12/2003 Suzuki et al.

FOREIGN PATENT DOCUMENTS

JP 9-179414 7/1997
JP 2000330358 A * 11/2000
JP 2003055473 A * 2/2003
JP 2003098841 A * 4/2003

* cited by examiner

*Primary Examiner*—Susan Lee
(74) *Attorney, Agent, or Firm*—Morgan, Lewis & Bockius LLP

(57) ABSTRACT

A transport belt has a belt base which is made of an elastic material, and a covering layer that covers a surface of the belt base. The covering layer contains an adherence repression filler to repress adherence to a contact member being in contact with a surface of the transport belt, which is dispersed at not less than 5 weight %.

11 Claims, 4 Drawing Sheets

FIG. 4A

| ADHERENCE REPRESSION FILLER (WEIGHT %) | 0 | 5 | 10 |
|---|---|---|---|
| ADHERENCE | ×× | ○ | ○ |

FIG. 4B

| THICKNESS COVERING LAYER (μm) | 2 | 3 | ..... | 15 | 16 | 17 | ..... |
|---|---|---|---|---|---|---|---|
| ADHERENCE | × (PEELING) | ○ | ..... | ○ | △ | ×× | ..... |

TRANSPORT BELT AND IMAGE FORMATION DEVICE USING THE SAME

BACKGROUND OF THE INVENTION

1. Field of the Invention

The present invention relates to a transport belt used in an image formation device such as a copying machine, printer, and facsimile, specifically to a transport belt in which the surface of the belt base made of an elastic material is covered with a covering material, and an image formation device using the same.

2. Description of the Related Art

In the image formation device such as a copying machine, printer, and facsimile, a device is already available that forms images on an image retainer such as a photosensitive drum, and transfers the images indirectly to a recording medium through an intermediate transfer belt, or transfers the images directly to the recording medium on a recording medium holding belt.

In this sort of transport belt (intermediate transfer belt, recording medium holding belt), with a view to maintaining the transfer performance of images from the image retainer to a satisfactory condition, it is essential to secure the nipping area between the transport belt and the image retainer and the pressure on the nipping area between the transport belt and the image retainer, and to increase the adherence between them.

To achieve these, a transport belt is already provided that forms the belt base itself of the transport belt with an elastic material such as a flexible rubber material and the like.

In a case of using a rubber material for the belt base, it is a general exercise to add chemicals in the rubber material in order to satisfy the properties such as resistance to ozone, fire resistance, antidegradation, etc.; however, there is a possibility that the added chemicals deposit on the surface of the transport belt, the so-called bleeding phenomenon occurs.

To solve such technological problems, there is already provided a technique that, while exhibiting the resistance to ozone and fire resistance by use of a mixed base material of chloroprene rubber and EPDM as the base material of the transport belt, effectively avoids the bleeding phenomenon (refer to the Patent Reference 1).

The Patent Reference 1 discloses that to disperse acetylene black, furnace black and acetylene black, or acetylene black and Ketjen black in the base material of a belt will repress the fluctuations with time of the electric resistance.

[Patent Reference 1]

Japanese Published Unexamined Patent Application No. Hei 9-179414 (detailed description of the invention)

This type of transport belt generally comes in a form that covers the surface of the belt base with a covering material, prevents degradation of the transport belt, and secures lubricity of the transport belt and so forth.

However, when the surface of the transport belt was put long in tight contact with the surface of the image retainer, the bleeding phenomenon was observed.

This is considered as follows: when the covering layer of the transport belt adheres to the surface of the image retainer, the negative pressure between both causes low-molecular oil compositions inside the belt base (contained in EPDM and various chemicals added during kneading) to deposit on the surface of the transport belt.

In this case, given conductive fine particles are dispersed in the base material of a belt, and these particles contribute to the adjustment of resistance (conductivity); however, they do not work to block the deposition of the low-molecular oil compositions, and they do not exhibit the function to repress the bleeding phenomenon at all. In the covering layer are dispersed a minute amount of a lubricant filler and a conductive filler and so forth. However, these fillers do not show the function to repress the bleeding phenomenon.

In order to avoid such deficiencies, indispensable is a technique that separates the image retainer from the transport belt through a retracting mechanism during non-image formation. However, this system needs to provide the retracting mechanism between both, which involves a technical problem that complicates the construction of the device to that extent.

SUMMARY OF THE INVENTION

The present invention has been made in view of the above technical problem, and provides a transport belt with a simple construction that securely prevents a bleeding phenomenon even though it is always in contact with an image retainer, and an image formation device using the same.

According to one aspect of the invention, as shown in FIG. 1A, the transport belt 1 includes a belt base 2 made of an elastic material, and a covering layer 3 that covers a surface of the belt base 2. In the covering layer 3 is dispersed an adherence repression filler 4*b* at not less than 5 weight %, which represses adherence to a contact member being in contact with a surface of the transport belt 1.

In the above technical unit, the transport belt 1 may appropriately select any one that possesses the belt base 2 made of an elastic material; taking up an example from an image formation device, an intermediate transfer belt and a recording medium holding belt correspond to the one.

The belt base 2 may take anyone that uses an elastic material, and it may contain various types of additives, including a conductive filler for resistance adjustment.

The covering layer 3 may take anyone that covers the surface of the belt base 2, and generally it may use one in which various types of fillers including a lubricant filler 4*c* to develop lubricity are dispersed in a resin binder 4*a*.

Here, the resin binder 4*a* may take one appropriately, and typically it may use a polyurethane resin, a polyester resin, or an acrylic resin.

Especially in this invention, it is essential to disperse in the covering layer 3 the adherence repression filler 4*b* at not less than 5 weight %, which represses the adherence to a contact member (for example, image retainer 6 illustrated in FIG. 1B) being in contact with the surface of the transport belt 1.

Here, if the adherence repression filler 4*b* in a given amount is dispersed in the resin binder 4*a*, it will develop the thixotropy of the resin, which hardens the covering layer 3 itself to more than a constant level; and if the covering layer 3 absorbs moisture, the hardness of the resin will be maintained, which makes it difficult to adhere to the contact member.

Now, if the filling amount of the adherence repression filler 4*b* is not sufficient, it will not repress the adherence to the contact member, and the filling amount needs 5 weight % at the lowest.

Although the adherence repression filler 4*b* does not especially specify the upper limit of the dispersion amount, the upper limit may appropriately take 50 weight %, for example, from the considerations of decrease in the resistance of leakage and decrease in the tearing strength, and so forth.

The adherence repression filler 4*b* may appropriately select one that contains at least a conductive filler, or one that contains at least an insulating filler. Here, to appropriately contain the conductive filler will make it possible to adjust the conductivity (resistance). In the transport belt 1 that does not need the resistance adjustment, there can be a case that disperses only the insulating filler.

Further, the adherence repression filler 4*b* does not need to be single species, and it may use one made of multiple species; moreover, it may be one that uses other functions in addition to the function to repress the adherence. Further, the adherence repression filler 4*b* may take an appropriate particle shape and size.

Surface roughness Rz of the covering layer 3 may appropriately be selected; however preferably, it is not less than 1.5 μm and not more than 9.0 μm. If it is less than 1.5 μm, there is a possibility that the contact member adheres to the covering layer 3. If it exceeds 9.0 μm, there is a possibility that the colorant toner and so forth adhere to the covering layer 3 to induce image quality degradations of halftone unevenness and so forth.

The thickness of the covering layer 3 may appropriately be selected; however preferably, it is not less than 3 μm and not more than 15 μm. If it is less than 3 μm, there is an inclination that the peeling strength of the covering layer 3 to a cleaning device, for example, becomes insufficient. If it exceeds 15 μm, there is a possibility that the adherence repression effect will not develop on the surface of the covering layer 3.

The present invention is intended for the transport belt 1, however it is not limited to this, and it is also intended for an image formation device using the same.

In this case, the invention relates to an image formation device, as shown in FIG. 1B, including the image retainer 6 and the transport belt 1 facing thereto, which transfer stoner images formed on the image retainer 6 onto the transport belt 1 or onto a recording medium 7 on the transport belt 1, in which the transport belt 1 uses the aforementioned transport belt.

In the construction that uses the transport belt 1 as the intermediate transfer belt, as shown in FIG. 1B, a primary transfer device 8*a* primarily transfers the toner images on the image retainer 6 onto the transport belt (intermediate transfer belt) 1, and then, a secondary transfer device 8*b* secondarily transfers the toner images on the intermediate transport belt (intermediate transfer belt) 1 onto the recording medium 7.

In the construction that uses the transport belt 1 as the recording medium holding belt, as shown in FIG. 1B, after holding the recoding medium 7 on the transport belt (recording medium holding belt) 1, a transfer device 8 transfers the toner images on the image retainer 6 onto the recording medium 7 on the transport belt (recording medium holding belt) 1.

In the image formation device illustrated in FIG. 1B is preferred a construction that stretches the transport belt 1 over plural extension rolls 9, and puts the transport belt 1 in contact with and along the shape of the drum-shaped image retainer 6.

According to this construction, to fit the transport belt 1 to the shape of the image retainer 6 as much as possible makes it possible to eliminate wasteful discharges by gaps before and behind the nipping area during transferring, and to prevent the toner images from flying about.

In the image formation device illustrated in FIG. 1B is preferred a construction that makes one of the image retainer 6 and the transport belt 1 function as the driving source, and makes the other one rotate to follow the driving source.

According to this construction, it is possible to eliminate one drive mechanism, and the cost related to the drive mechanism can be reduced to that extent. Moreover, it is possible to eliminate fluctuating factors such as thickness fluctuations of the transport belt 1 resulting from the drive interference between the transport belt 1 and the image retainer 6, feed fluctuations in the feed direction, and so forth.

BRIEF DESCRIPTION OF THE DRAWINGS

Preferred embodiments of the present invention will be described in detail based on the followings, wherein:

FIG. 4A is an explanatory chart illustrating the relation between the surface roughness and the adherence repression effect of the covering layer in the embodiment 1, and FIG. 4B is an explanatory chart illustrating the relation between the film thickness and the adherence repression effect of the covering layer in the embodiment 2.

DETAILED DESCRIPTION OF THE PREFERRED EMBODIMENTS

Figure 1A:
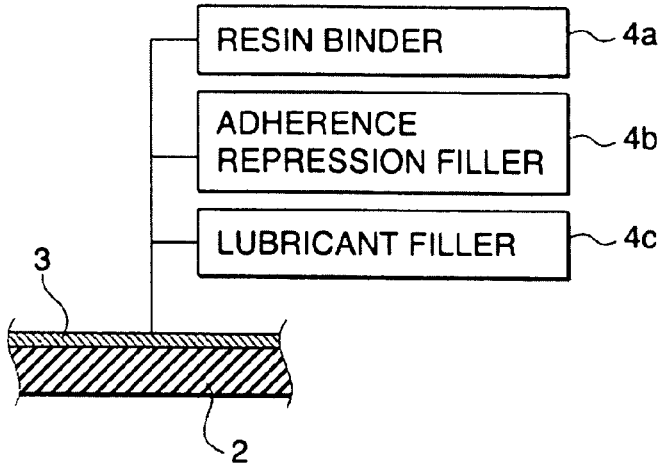
FIG. 1A is an explanatory chart illustrating the outline of a transport belt relating to the invention.
Figure 1B:
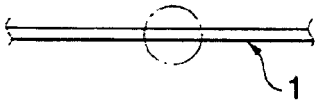
FIG. 1B is an explanatory chart illustrating the outline of an image formation device relating to the invention.
Figure 1C:
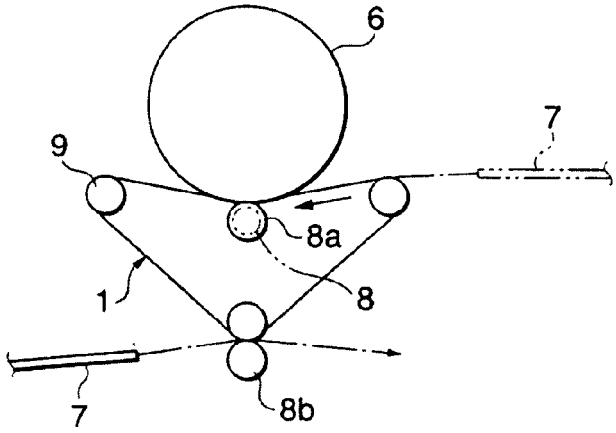
Figure 2A:
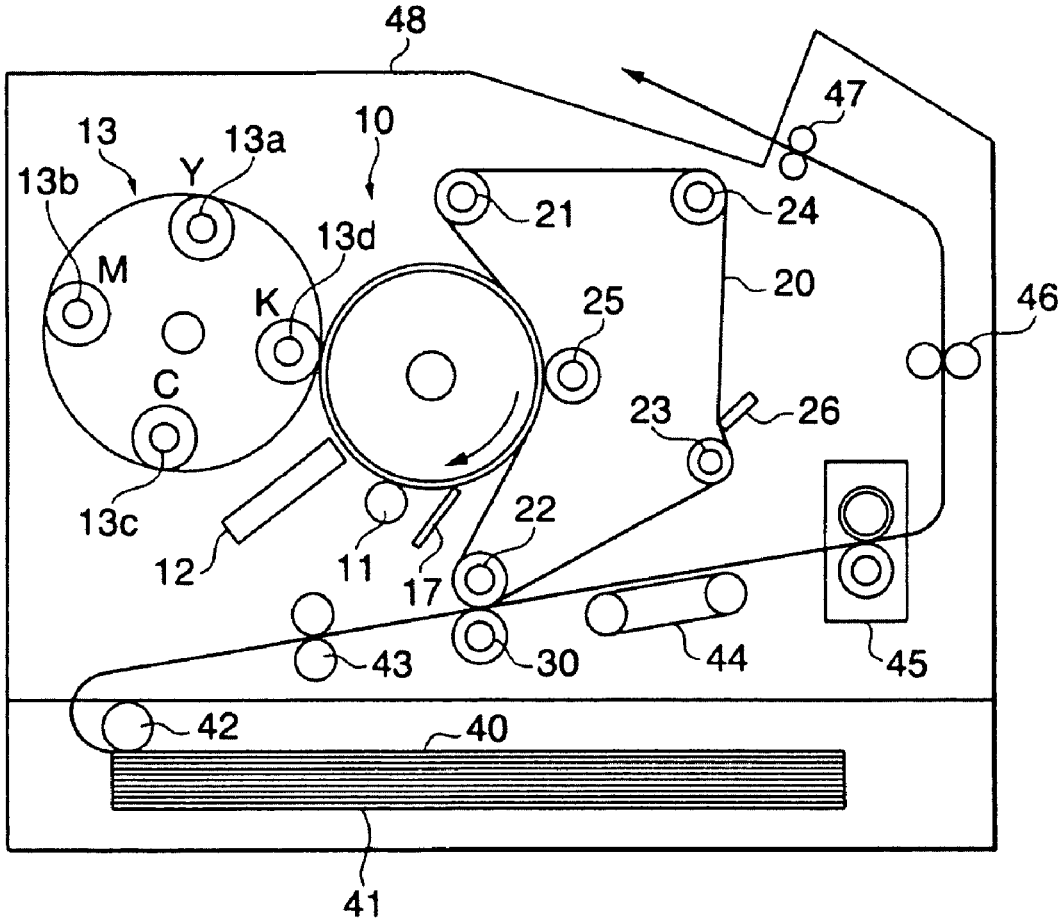
FIG. 2A is an explanatory chart illustrating the whole construction of the image formation device relating to the embodiment.

FIG. 2A illustrates the embodiment of the image formation device to which the invention is applied.

In the drawing, the image formation device possesses a photosensitive drum 10, and an intermediate transfer belt 20 that comes in contact with the photosensitive drum 10 and travels along the shape of the photosensitive drum 10 in a given area.

In this embodiment, the photosensitive drum 10 is provided with a photosensitive layer of which resistance is decreased by irradiating it with a light. On the periphery of the photosensitive drum 10 are disposed an electrification device 11 that electrifies the photosensitive drum 10, an exposure device 12 that writes electrostatic latent images of each of the colors (yellow, magenta, cyan, and black in this example) on the electrified photosensitive drum 10, a rotary-type developing device 13 that visualizes the latent images of each of the colors formed on the photosensitive drum 10 by the toners of each of the colors, the intermediate transfer belt 20, and a cleaning device 17 that cleans off residual toners on the photosensitive drum 10.

Here, as the electrification device 11, a charging roll, for example, is employed, however an electrifier such as a corotron may be used.

The exposure device 12 may be one that can write images on the photo sensitive drum 10 by a beam of light. In this example, a print head using an LED is used, but the present invention is not limited to this, and a print head using an EL or a scanner that scans laser beams by a polygon mirror may appropriately be selected.

The rotary-type developing device 13 rotatably mounts development counters 13*a* through 13*d* that contain toners of each of the colors. If it is to make the toners of each of the colors adhere to the parts on the photosensitive drum 10, of which potentials are lowered by the exposure, it may appropriately be used. There are not any restrictions on the particle shape and size of the toner to be used, and it may be used as long as it can be put accurately on the electrostatic latent images on the photosensitive drum 10. Here in this example, the rotary-type developing device 13 is used, however four separate developing devices may be used instead.

With regard to the cleaning device 17, as long as it cleans off residual toners on the photosensitive drum 10, any one adopting the blade cleaning system and so forth may be selected appropriately. However, there can be a case that does not use the cleaning device 17, when using a toner of high transfer efficiency.

Figure 2B:
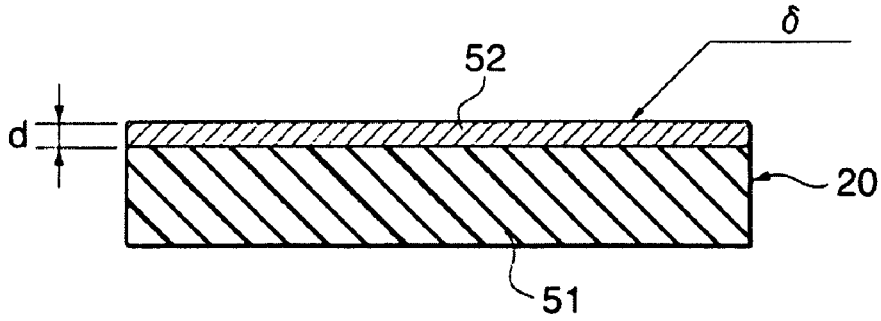
FIG. 2B is an explanatory chart illustrating the sectional structure of the intermediate transfer belt (transport belt)

The intermediate transfer belt 20 is hung over four extension rolls 21 through 24, as shown in FIG. 2B, and is disposed along the shape of, and in tight contact with a given contact area of the surface of the photo sensitive drum 10, which is located between the rotary-type developing device 13 and the cleaning device 17.

Now, it may be arranged to drive the intermediate transfer belt 20 and the photosensitive drum 10 individually by means of separate drive systems. In this embodiment however, the intermediate transfer belt 20 is an elastic belt, as described later; in addition, it is disposed along and in tight contact with the circumference of the photosensitive drum 10. In view of this construction, the intermediate transfer belt 20 is driven to rotate with the photosensitive drum 10 as the driving source.

A primary transfer roll 25 as the primary transfer device is disposed on the backside of the intermediate transfer belt 20, to come in contact with a part of the contact area where the intermediate transfer belt 20 adheres to the photosensitive drum 10, and a given primary transfer bias is applied to the primary transfer roll 25.

A secondary transfer roll 30 as the secondary transfer device is disposed at a part facing to the extension roll 22 for stretching the intermediate transfer belt 20, with the extension roll 22 served as the backup roll; for example, a given secondary transfer bias is applied to the secondary transfer roll 30, and the extension roll 22 served both as the backup roll is grounded.

A cleaning roll 26 as the belt cleaner is disposed at a part facing to the extension roll 23 for stretching the intermediate transfer belt 20; a given cleaning bias is applied to the cleaning roll 26, and the extension roll 23 is grounded.

A recording medium 40 such as paper is contained in a supply tray 41, which is supplied by a pickup roll 42. Thereafter, it is guided to the secondary transfer area through a resist roll 43, is transported to a fixation device 45 by means of a transport belt 44, and is discharged to a discharge tray 48 through a transport roll 46 and a discharge roll 47.

In this embodiment, as shown in FIG. 2B, the intermediate transfer belt 20 includes a belt base 51 made of an elastic material, and a covering layer 52 that covers the surface of the belt base 51.

Here, as the material for the belt base 51 used in this embodiment are enumerated vulcanized rubber and thermoplastic elastomer. And, as the rubber raw material is enumerated a general diene rubber, for example, styrene-butadiene rubber (SBR), poly-isoprene rubber (IIR), ethylene propylene diene rubber (EPDM), poly-butadiene rubber (BR), acrylic rubber (ACM, ANM), and so forth. From the viewpoints of the stiffness properties being comparably high, the volume resistivity being close to semiconductivity, and the flow properties in the mold being excellent, the followings are preferable: acrylonitrile-butadiene rubber (NBR), hydrogenation NBR, chloroprene rubber (CR), epichlorohydrin rubber (CO, ECO), polyurethane rubber (PUR), and so forth.

On the other hand, as the thermoplastic elastomer are used the polyester system, polyurethane system, styrene-butadiene system, polyolefin system, and so forth. To use such thermoplastic elastomer will make recycling possible, which is friendly to environments.

Further, the material for the belt base 51 is not necessarily of single species, and a material having more than two species blended may be used. For example, the material having chloroprene rubber (CR) and EPDM blended is practically used.

And, to add a conductive filler and an insulating filler to the belt base 51 will adjust the volume resistivity of the belt base 51.

As the shape of the fillers, any shapes may be used, such as particulate and fibrous, etc. As the conductive filler, the followings can be listed: metallic salt such as carbon black, Ketjen black, acetylene black, zinc oxide, potassium titanate, tin oxide, graphite, $LiClO_4$, $LiAsF_6$, and various species of class 4 ammonium salt, etc. As the insulating filler, silica can be listed.

Other than the above compositions, the following compounds for rubber can be used for the belt base 51.

As the filler, for example, titanium oxide, magnesia oxide, calcium carbide, calcium sulfate, clay, talc, silica, and so forth can be listed; as the compounds for rubber, curing agent, curing promoter, antioxidant, plasticizer, processing oil, and so forth can be listed; and as the coloring agent, various types of pigments can be listed.

With regard to the manufacturing method of the belt base 51, arbitrary methods may be applied, and the following is one example.

To manufacture the belt base 51 by use of, for example, a material having chloroprene rubber (CR) and EPDM blended needs to blend and disperse, for example, a conductive filler into the chloroprene rubber and EPDM, thereafter to mix and knead these chloroprene rubber and EPDM with a mixer, to add a curing agent, and to extrude the material thus processed to form the belt.

Now, when extruding the above kneaded material to form the belt base 51, a metal cylinder called the curing mandrel, of which outer diameter is the same in size as the inner diameter of the belt, is covered with the blended and kneaded material for the belt base 51, which is vulcanized under a given condition (for example, at 150° C. about one hour). Thereafter, while varying the curing time according to the required modulus, the secondary curing is treated under a given condition (for example, at 110° C. about 15 hours). And then, a polishing mandrel is covered with the belt base 51, and the inner and outer peripheries of the belt base 51 are polished to obtain the smoothness of the surface.

Figure 3A:
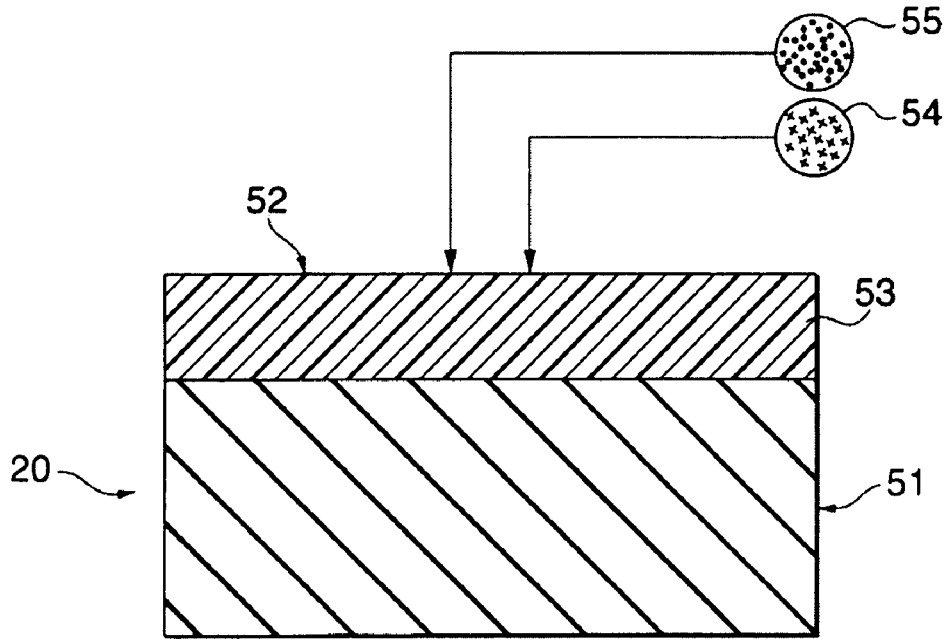
FIG. 3A is an explanatory chart illustrating the construction of the covering layer of the intermediate transfer belt.

The covering layer 52 uses a polyurethane resin, a polyester resin, or a polyacrylic resin as a binder 53, as shown in FIG. 3A, and in the binder 53 is dispersed a predetermined filler, typically a lubricant filler 54 as well as an adherence repression filler 55.

As the lubricant filler 54, the resin powder of fluorinated compounds such as PTFE, ETFE, PFA is used, in which the surface activating agent is dispersed as required.

On the other hand, as the adherence repression filler 55, either of the conductive filler and the insulating filler can be used, and a combination of both may be used. The shape of the adherence repression filler 55 may be set arbitrarily, but particulate is preferred since the covering layer 52 is considerably thin.

As the conductive filler, the following metallic oxide can be listed: carbon black, carbon white, titanium oxide, tin oxide, magnesium oxide, silicon antimony oxide, aluminum oxide, etc. As the insulating filler, pigments and silica and so forth can be listed.

Especially, the adherence repression filler 55 is required to be filled not less than 5 weight % in total. However, if the filling rate of the adherence repression filler 55 exceeds the upper limit (for example, 50 weight %), the leakage resistance will decrease in the case of a conductive filler. If it is made of an insulating filler, it will invite a decrease in the tearing strength; it is accordingly preferable to define the upper limit as 50 weight %.

To manufacture the covering layer 52 needs to blend and disperse the lubricant filler 54 and the adherence repression filler 55 into the binder 53, and to apply the above blended and dispersed compound over the belt base 51 by means of the dip coating, spray coating, electrostatic coating, roll coating, and so forth. Here, to adjust the surface roughness of the covering layer 52 needs to polish the surface of the covering layer 52 as required, by means of the polishing process (to cover the polishing mandrel with the intermediate transfer belt 20 and polish the surface of the belt).

Figure 3B:
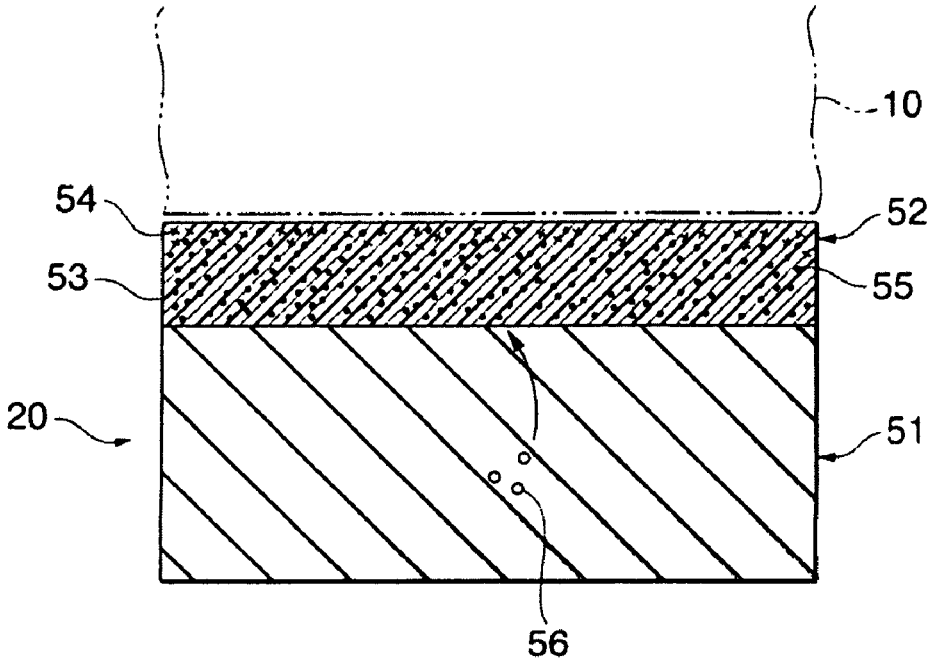
FIG. 3B is an explanatory chart illustrating the function of the covering layer of the intermediate transfer belt.

Now, the adherence repression filler 55 is dispersed substantially uniformly in the resin binder 53 of the covering layer 52, as shown in FIG. 3B. In contrast to this, the lubricant filler 54 is dispersed one-sidedly toward the surface of the covering layer 52. It is because the specific gravity of the lubricant filler 54 is lower than that of the adherence repression filler 55, and it is apt to be dispersed one-sidedly toward the surface of the resin binder 53.

In this embodiment, the thickness d of the covering layer 52 is set as being not less than 3 μm and not more than 15 μm, as shown in FIG. 2B.

The lower limit of the thickness d of the covering layer 52 is defined as 3 μm in this embodiment, because, if it is thinner than this, it will not give a necessary mechanical strength and durability (there is a possibility that the mechanical abrasion by the cleaning device peels the covering layer 52).

On the other hand, the upper limit of the thickness d of the covering layer 52 is defined as 15 μm, because, if it is thicker than this, the adherence repression effect by the adherence repression filler 55 will not develop, in addition to an unavoidable cost increase in the coating process of the covering material.

Further, in this embodiment, the surface roughness Rz (δ) of the covering layer 52 is set as being not less than 1.5 μm and not more than 9 μm.

The lower limit of the surface roughness Rz of the covering layer 52 is defined as 1.5 μm in this manner because, if it is lower than this, the covering layer 52 and the photosensitive drum 10 will easily adhere to each other, in addition to a possible cost increase due to an excessive increase of time required for the polishing process.

On the other hand, the upper limit of the surface roughness Rz of the covering layer 52 is defined as 9 μm because, if it is higher than this, the used toner (for example, the average particle size 5 to 8 μm) will become easy to be trapped mechanically on the side of the intermediate transfer belt 20, which will lead to image quality deficiencies such as halftone unevenness.

Next, the operation of this image formation device will be described.

In FIG. 2A, when the image formation device starts the image formation operation, the device forms the toner images of respective colors sequentially on the photosensitive drum 10, and the transfer field of the primary transfer roll 25 sequentially transfers the toner images onto the intermediate transfer belt 20.

Thereafter, the transfer field of the secondary transfer roll 30 transfers the toner images primarily transferred to the intermediate transfer belt 20 secondarily to the recording medium 40, and the recording medium 40 is transported to the fixing process.

In this image formation process, the lubricity between the photosensitive drum 10 and the intermediate transfer belt 20 is maintained excellently, which will prevent a sharp increase of the friction resistance between the photosensitive drum 10 and the intermediate transfer belt 20.

In this embodiment, as shown in FIG. 3B, since the covering layer 52 of the intermediate transfer belt 20 contains the lubricant filler 54 being dispersed one-sidedly toward the surface thereof, the friction resistance of the intermediate transfer belt 20 to the photosensitive drum 10 is lowered.

On the other hand, in this embodiment, the adherence between the photosensitive drum 10 and the intermediate transfer belt 20 is restrained.

Concretely, in the covering layer 52 of the intermediate transfer belt 20, since the resin binder 53 of a polyurethane resin and the like contains the adherence repression filler 55 at not less than 5 weight %, being dispersed uniformly, it is estimated that the thixotropy of the resin binder 53 develops, and the covering layer 52 itself is hardened to more than a constant level.

In this state, if the covering layer 52 absorbs moisture, the hardness of the resin binder 53 is maintained. Therefore, if the photosensitive drum 10 and the intermediate transfer belt 20 are located in contact, both are restrained from completely adhering.

Accordingly, there will not be a possibility that both adhere completely to thereby bring both into a negative pressure. Therefore, if there exist low-molecular oil compositions 56 of various chemicals in the belt base 51, the low-molecular oil compositions 56 will not be suck out to the surface of the intermediate transfer belt 20; and the so-called bleeding phenomenon will not come into existence.

If the photosensitive drum 10 and the intermediate transfer belt 20 are always disposed in contact, the bleeding phenomenon will be prevented; accordingly, a retracting mechanism for separating the photosensitive drum 10 and the intermediate transfer belt 20 becomes unnecessary, which attains the cost reduction to that extent, in addition to the possibility of using an inexpensive elastic material for the belt base 51.

In the constructional model of this embodiment, the intermediate transfer belt 20 is rotated to follow the drive of the photosensitive drum 10, which cuts down the drive control cost of the intermediate transfer belt 20 to a great extent.

Further, the contact breadth of the intermediate transfer belt 20 to the photosensitive drum 10 is set very wide such as not less than 50 mm, and thereby the intermediate transfer belt 20 achieves a stably driven movement to the photosensitive drum 10. Moreover, since there are not useless gaps before and behind the transfer nipping area, the primary transfer is carried out in a state that discharges by the gaps are repressed to prevent the toners from flying about.

Especially in this embodiment, the transfer nipping area between the photo sensitive drum 10 and the intermediate transfer belt 20 are secured wide, which reduces the pressure on the transfer nipping area. Owing to the reduced pressure, it is more reliably avoided that the photosensitive drum 10 and the intermediate transfer belt 20 completely adhere.

In this embodiment, the photosensitive drum 10 and the intermediate transfer belt 20 are disposed in contact to overlap each other, and the intermediate transfer belt 20 is rotated to follow the driving force from the photosensitive drum 10, however, the present invention is not limited to this. Needless to say, the present invention can be applied to a construction such that the photosensitive drum 10 and the intermediate transfer belt 20 possess individual drive systems, and the intermediate transfer belt 20 is in linear contact with the photosensitive drum 10.

EXAMPLE 1

This example relates to a further concrete one of the intermediate transfer belt 20 to be used in the embodiment, in which the filling amount of the adherence repression filler 55 is varied, and the adherence repression effect by the variation is evaluated.

The intermediate transfer belt 20 in this example is constructed as follows.

Belt base 51:

having chloroprene rubber (CR) and EPDM kneaded, and paraffin oil dispersed during kneading, curing promoter added to EPDM.

Covering layer 52:

Thickness d; 10 μm

Surface roughness Rz; 4.5 μm

Resin binder 53; polyurethane resin

The lubricant filler 54; filled with one having the surface-activating agent dispersed in the aqueous resin of polyurethane emulsion (PTFE) as required, by 5 weight %.

The adherence repression filler 55; filled with carbon black as the conductive filler by 15 weight %.

Here, an OPC sensing material was used in the photosensitive drum 10.

In this example, a long-term storage test was conducted under a high temperature and high humidity while putting the image retainer and belt base in adhesion. The result confirmed that the adherence repression effect is developed sufficiently.

Now, the adherence evaluation test was made, using the intermediate transfer belt 20 having different filling amounts of the adherence repression filler 55, and the result was obtained as shown in FIG. 4A. In FIG. 4A, the mark 0 shows the state that the adherence repression effect is sufficiently developed, and the mark xx shows the state that the adherence repression effect is extremely bad, as the evaluation of the adherence.

According to FIG. 4A, if the filling amount of the adherence repression filler 55 is not less than 5 weight %, it is understood that the adherence repression effect is sufficiently developed.

EXAMPLE 2

The adherence evaluation test similar to the example 1 was made, using the intermediate transfer belt 20 having a substantially the same construction as that of the example 1, varying the thickness d of the covering layer 52 as the parameters, the result was obtained as shown in FIG. 4B.

According to FIG. 4B, it was confirmed that the adherence repression effect was sufficiently developed, with the thickness d of the covering layer 52 being not less than 3 μm and not more than 15 μm. And, when the thickness d was 2 μm, it was observed that the covering layer 52 was peeled off at an early stage, resulting from the contact of the covering layer 52 with, for example, the cleaning member of the cleaning device. On the other hand, it was confirmed that when the thickness d was 16 μm, the adherence repression effect became insufficient, and when the thickness d is 17 μm or over, the adherence repression effect becomes extremely bad.

According to the invention thus described, the adherence repression filler in a given amount is dispersed in the surface-covering layer of the belt base made of an elastic material, which makes it possible to repress the adherence to the contact member in contact with the surface of the transport belt.

Owing to this adherence repression effect, if the transport belt and the contact member are put in contact with each other over a long period, the adherence between both can be restrained, which effectively prevents the so-called bleeding phenomenon in which low-molecular oil compositions dispersed in the belt base made of an elastic material are deposited on the surface of the intermediate transfer belt.

Further, the image formation device using this type of transport belt is able to restrain the adherence to the image retainer as the contact member being in contact with the surface of the transport belt; therefore, the bleeding phenomenon can effectively be prevented, with the image retainer and the transport belt always in contact. Thereby, it becomes unnecessary to provide a retracting mechanism for separating the transport belt and the image retainer, which achieves simplicity of the device construction to that extent.

The entire disclosure of Japanese Patent Application No. 2003-160323 filed on Jun. 5, 2003 including specification, claims, drawings and abstract is incorporated herein by reference in its entirety.

What is claimed is:

1. An image formation device comprising:

a rotatable photosensitive drum;

a transfer belt wrapping around a part of the photosensitive drum to form a nip area and being driven by rotation of the photosensitive drum, the transfer belt comprising a base containing a diene rubber and low molecular oil, and a covering layer formed on the base containing at least an adherence repression filler; and a pressing member that presses the transfer belt against the photosensitive drum at a pressing point, wherein the nip area is formed at both upstream and downstream sides in a rotation direction of the photosensitive drum with respect to the pressing point, and wherein the covering layer contains at least 5% by weight of the adherence repression filler dispersed therein.

2. The image forming device according to claim 1, wherein the covering layer further contains a binder resin.

3. The image formation device according to claim 2, wherein the binder resin is one of a polyurethane resin, a polyester resin and an acrylic resin.

4. The image formation device according to claim 1, wherein the covering layer further contains a lubricant filler.

5. The image formation device according to claim 1, wherein the adherence repression filler contains at least a conductive filler.

6. The image formation device according to claim 5, wherein the conductive filler is carbon black.

7. The image formation device according to claim 1, wherein the adherence repression filler contains at least an insulating filler.

8. The image formation device according to claim 1, wherein a surface roughness of the covering layer is not less than 1.5 μm and not more than 9.0 μm.

9. The image formation device according to claim 1, wherein a thickness of the covering layer is not less than 3 μm and not more than 15 μm.

10. The image formation device according to claim 1, wherein a width of the nip area is at least 50 mm.

11. The image formation device according to claim 1, wherein the covering layer contains aqueous resin.

* * * * *